United States Patent [19]

Anderson

[11] Patent Number: 4,958,617

[45] Date of Patent: Sep. 25, 1990

[54] ARCHERY ARROW AND SABOT

[76] Inventor: Jeffrey R. Anderson, 162 Slocum Lake Rd., Wauconda, Ill. 60084

[21] Appl. No.: 327,769

[22] Filed: Mar. 23, 1989

Related U.S. Application Data

[63] Continuation-in-part of Ser. No. 80,019, Jul. 31, 1987, Pat. No. 4,829,974.

[51] Int. Cl.[5] ..... F41B 5/00; A63B 65/02

[52] U.S. Cl. ..... 124/24.1; 124/83; 124/88; 124/44.5; 124/41.1; 273/416

[58] Field of Search ..... 124/23 R, 24 R, 26, 124/41 R, 41 A, 82, 83, 84, 86, 88–91; 273/416–423; 102/520, 521

[56] References Cited

U.S. PATENT DOCUMENTS

| | | | |
|---|---|---|---|
| 948,177 | 2/1910 | Lehmann | 273/420 |
| 1,210,332 | 12/1916 | Kvistad | 124/24 R |
| 2,212,345 | 8/1940 | Krieger | 273/420 |
| 2,443,395 | 6/1940 | Lutins | 273/420 X |
| 4,027,645 | 6/1977 | Damron | 124/24 R |
| 4,146,009 | 3/1979 | Adams | 124/88 |
| 4,266,782 | 5/1981 | Patterson | 273/423 |
| 4,290,407 | 9/1981 | Damron | 124/41 A |
| 4,291,664 | 9/1981 | Nishioka | 124/41 A |
| 4,385,618 | 5/1983 | Nishioka | 124/24 R |
| 4,446,844 | 5/1984 | Nishioka | 124/41 A |
| 4,574,703 | 3/1986 | Halverson | 102/520 |
| 4,644,866 | 2/1987 | Sullivan | 102/529 X |
| 4,693,229 | 9/1987 | Nishioka | 124/41 A |

FOREIGN PATENT DOCUMENTS

| | | | |
|---|---|---|---|
| 913460 | 10/1972 | Canada | 102/520 |
| 2537116 | 3/1976 | Fed. Rep. of Germany | 102/520 |

*Primary Examiner*—Randolph A. Reese
*Assistant Examiner*—John Ricci
*Attorney, Agent, or Firm*—Lockwood, Alex, Fitzgibbon & Cummings

[57] ABSTRACT

A short archery arrow equipped with a sabot and a launching barrel therefor that may be used with either a regular bow or a crossbow. When in the form of a hunting arrow, the cutting blades alone provide all the required fletching action and the center of gravity of the arrow lies forwardly of the blades. The blades are preferably not sharpened when the arrows are used for target shooting. The sabots and launching barrels have interfitting tongue and groove formations which provide guidance action to the arrows. On leaving the launching barrel the sabots separate from the arrows due to wind resistance action on the sabots.

11 Claims, 1 Drawing Sheet

ARCHERY ARROW AND SABOT

This application is a continuation-in-part of my prior application Serial No. 080,019 filed July 31, 1987 which issued as Patent No. 4,829,974 on May 16, 1989.

This invention relates, generally, to innovations and improvements in archery arrows to be shot from either conventional bows or from crossbows and to sabots and launching barrels for use in combination with the new and improved arrows.

More particularly, the invention relates to archery arrows used for hunting which are relatively short (e.g. 4–7 inches long) and in which the cutting blades are used as the fletchings of the arrows. By not sharpening the fletching blades or by forming them from a non-sharp material, the arrows of the present invention can also be used for target practice.

The general object of the invention is to provide archery arrows which can be shot from either regular bows or crossbows and which will fly further, faster, and with greater accuracy than presently available archery arrows.

A further object of the invention is the provision of improved sabots which are to be used in combination with the arrows of the present invention and further to launching barrels from which the improved arrows with the sabots attached may be shot with improved accuracy.

Still another important object of the invention is to provide a new and improved combination of an arrow, sabot and launching barrel which may be utilized on either conventional bows or crossbows.

Certain other objects of the invention will be apparent to those skilled in the art in view of the following detailed description of presently preferred embodiments of the invention taken with the accompanying drawings, wherein.

Figures 1, 2, 3, 4, 5, 6, 7, 8:
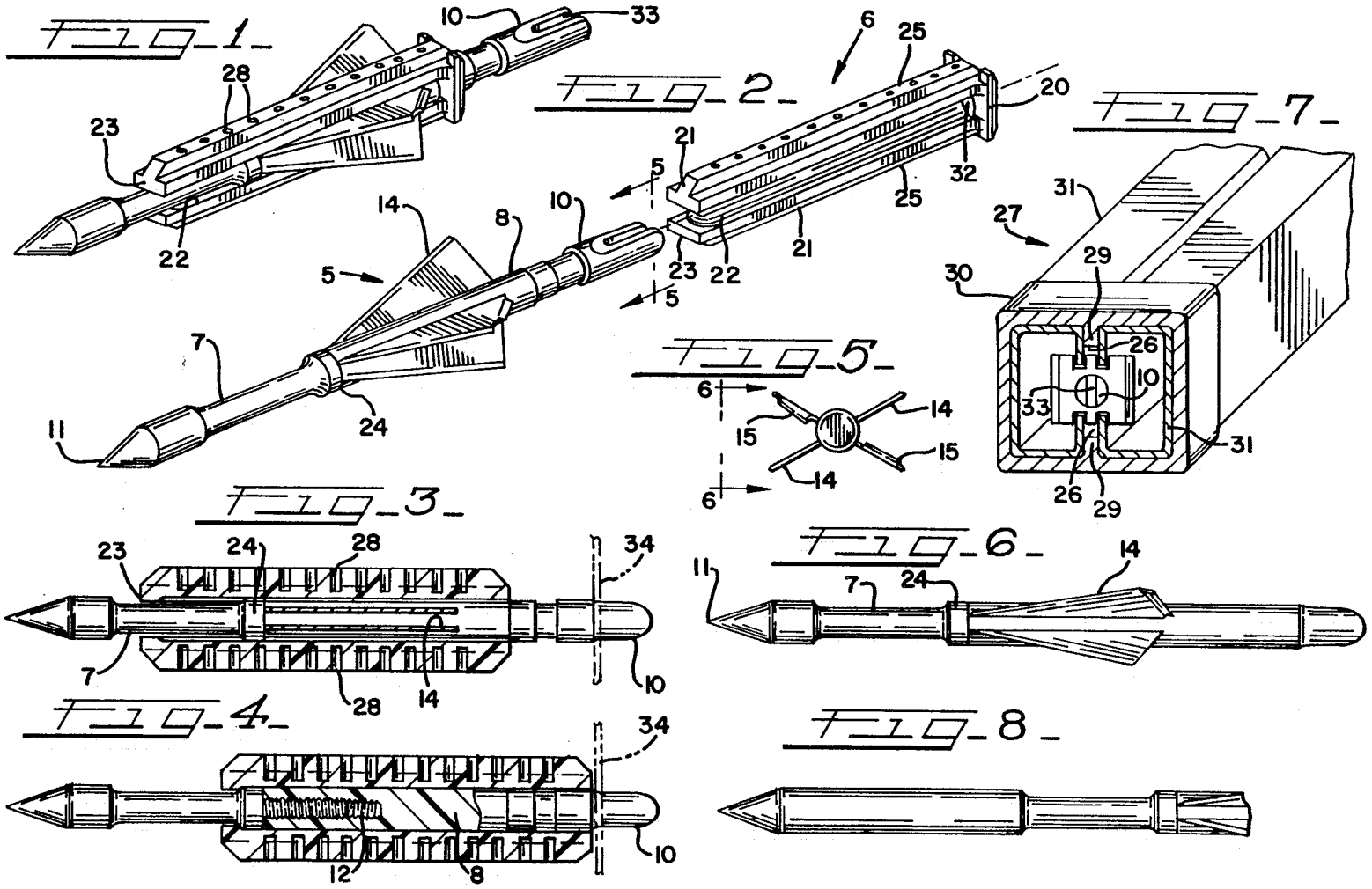
FIG. 1 is a perspective view of an arrow embodying the present invention having a sabot attached and ready to be loaded into either a regular bow or a cross bow.
FIG. 2 is an exploded perspective view showing the arrow and sabot combination of FIG. 1 separated from each other.
FIG. 3 is a longitudinal sectional view of the arrow/-sabot combination of FIG. 1 with the arrow shaft in elevation.
FIG. 4 is a longitudinal sectional view corresponding to FIG. 3 with the sabot fully retracted on the arrow and showing arrow shaft partly in section.
FIG. 5 is an end view of the arrow taken on line 5—5 of FIG. 2.
FIG. 6 is a side elevational view of the arrow taken on line 6—6 of FIG. 5.
FIG. 7 is a fragmentary end sectional perspective view of a launching barrel from which the combination arrow/sabot of FIG. 1 may be launched.
FIG. 8 is a side elevational view of an arrow having a longer tip end than the arrow in FIGS. 1–6.

Referring to FIGS. 1 and 2, an arrow is indicated generally at 5 and a sabot is indicated generally at 6 which when mated together form the arrow/sabot combination shown in FIG. 1. The arrow 5 is formed in three parts including a front section 7 and a rear section 8 to the rear end of which a nock 10 is attached. When the arrow 5 is used as a hunting arrow, its point end 11 will be sharpened.

A threaded stem 12 (FIG. 4) extends axially from the rear end of the front section 7. The leading end of rear section 8 is internally threaded and screwed onto the stem 12 so as to form with the front section 7 the shaft of the arrow 5.

The inner horizontal edges of four triangular blades 14—14 are inserted into axially elongated slots (not shown) formed in the exterior body of the rear section 8. The blades 14 may be force-fitted into the slots with suitable tooling so as to be removable and replacable if required. From FIG. 5, it will be seen that the blades 14 extend radially from the tubular rear section 8 and are oriented at the two o'clock, four o'clock, eight o'clock, and ten o'clock positions. The rear edges of two blades are oppositely bent as indicated at 15—15 (FIG. 5) so as to impart a spin to arrow 5 during flight.

For hunting purposes it will be understood that the rearwardly inclined edges of the blades 14 will be razor sharp. For target purposes these edges will be left dull and the pointed end 11 will be left dull.

By forming the front end portion 7 of a heavier or denser material, preferably steel, and the rear section 8 of a lighter material such as aluminum, the center of the gravity of the arrow 5 will be located forwardly of the blades 14. The blades 14 provide all of the fletching action required for the arrow 5. By having the arrow 5 designed so that its center of gravity is forward of the blades 14 and utilizing the blades 14 to provide the fletching action, the arrow 5 has excellent aerodynamic properties in flight.

The sabot 6 is preferably formed of light-weight material such as high density polyethylene, nylon, or aluminum. It comprises a rectangular heel or base 20 from which a pair of parallel guidance fingers 21—21 extend. The inner opposing surfaces of the fingers 21 have elongated arcuate recesses 22 and are so spaced apart as to fit opposing exterior surfaces of the rear arrow portion 8. The elongated recesses 22 terminate so as to leave distal end portions 23 which engage the smaller diameter portion of the front section 7 forwardly of the land 24. On the outer side of each finger 21, a rib 25 extends the purpose of which is to fit into guidance grooves 26—26 (FIG. 7) provided by launching barrel which is indicated generally at 27. Preferably, the ribs 25 have a plurality of holes 28—28 to decrease the mass of the sabot 6. The launching barrel 27 comprises spaced front and rear end supports 30—30 (only one being shown) which support therebetween a pair of rails 31—31. The rails 31 may be extruded from aluminum or machined or otherwise formed from suitable material and are generally C-shaped. The end supports 30 have opposing internal ribs 29 which serve to maintain the spacing between the rails 31 and maintain the elongated guidance grooves or slots 26 therebetween.

The heel 20 of the sabot 6 has a center opening 32 (FIG. 2) which fits the arrow shaft section 8 and allows the sabot to slide thereon.

As shown in FIG. 7, the launching barrel 27 is oriented for mounting on a regular (e.g. long bow) bow with the bow string slot 33 in the nock 10 vertically oriented to receive the bow string 34 (FIGS. 3 and 4). For example, the barrel 27 may be used to replace the longitudinally slidable barrel shown and described in my co-pending Application Serial No. 080,019 filed July 31, 1987. The disclosure of such co-pending application is incorporated by reference herein. Alternatively, the arrow 5-sabot 6 combination may be launched using the slidable barrel.

In use, the sabot 6 is mounted onto the arrow 5 and pushed forwardly thereon until the heel 20 engages the rear edges of the blades 14 as shown in FIGS. 1 and 3. The arrow 5 with sabot 6 attached is then loaded into the rear end of the barrel 27. As soon as the arrow 5 leaves the muzzle end of the barrel 27 on being shot, the wind resistance acting on the heel 20 will cause the sabot 6 to separate from the nock end of the arrow and fall to the ground. Once the sabot 6 leaves the muzzle of barrel 27 the legs 21 are free to spread apart allowing the sabot to separate from the arrow 5. The fit between the sabot 6 and barrel 27 is such that during passage through the barrel 27 the legs 21 are restrained from spreading and the sabot 6 will not separate from the arrow until the separating force of wind resistance is applied.

The launching barrel 27 may be stationarily mounted on a crossbow in which case it will be rotated 90° from the orientation shown in FIG. 7 since bow string of a crossbow is horizontal. When the arrow 5 is to be shot from a crossbow, the nock 10 will preferably be replaced with the usual blunt nock end piece. Otherwise, no changes are required.

What is claimed is:

1. An archery arrow comprising a shaft having a point at one end and a nock on the opposite end and fletching consisting of blades located rearwardly of the center of gravity of the arrow, the trailing edges of two opposing blades being bent so as to induce axial spin in flight, and said arrow having a length not exceeding about 7 inches.

2. The archery arrow of claim 1, wherein said fletching blades are sharpened.

3. The archery arrow of claim 1, wherein there are four fletching blades.

4. A sabot for an archery arrow which travels with the arrow as unit until its guidance function ceases and separation therefrom occurs comprising a heel having an opening permitting the heel to slidably receive the shaft of an arrow and a plurality of parallel arrow guidance fingers extending from said heel.

5. The sabot of claim 4, wherein there is one pair of guidance fingers which spread apart when not restrained.

6. The combination of an archery arrow comprising a shaft with a point end and a nock end and having a plurality of fletching blades on its shaft and a sabot which travels with the arrow as a unit until its guidance function ceases and separation therefrom occurs comprising a heel portion which fits slidably on the arrow shaft and a plurality of arrow guidance fingers which extend from said heel along the arrow shaft in the direction of said point end.

7. In the combination of an arrow and a sabot as called for in claim 6, said plurality of fletching blades comprising four blades extending radially from the arrow shaft in approximately the two o'clock, four o'clock, eight o'clock and ten o'clock directions.

8. In combination, an archery arrow, a sabot on the arrow, and a barrel for launching the arrow with the sabot thereon;

said arrow comprising a shaft having a point end and a nock end and a plurality of fletching blades mounted thereon;

a sabot comprising a heel with an opening allowing it to fit slidably on said arrow shaft and a plurality of arrow guidance fingers extending along said shaft from said heel toward said point end; and a launching barrel comprising elongated members having guidance formations which slidably engage at least portions of said guidance fingers.

9. The combination of claim 8, wherein said sabot has an interference fit with said arrow which suffices to prevent the sabot from falling off the arrow when no separating force is applied while the wind resistance action on said heel of said sabot causes said sabot to separate from said arrow when the arrow leaves the muzzle of said barrel.

10. The combination of claim 8, wherein said barrel guidance formations provide spaced opposing grooves and said sabot guidance fingers have ribs which interfit in said grooves.

11. The combination of claim 10, wherein said guidance fingers and said arrow shaft have interfitting, formations which prevent separation thereof when said guidance fingers engage said arrow shaft and are restrained from spreading apart, and wherein said guidance fingers include formations which engage said barrel guidance formations and restrain said guidance fingers from spreading.

* * * * *